United States Patent [19]

Bjorklund

[11] 4,181,262

[45] Jan. 1, 1980

[54] PURGING APPARATUS

[76] Inventor: Curt A. Bjorklund, Box 99, Ulricehamn, Sweden

[21] Appl. No.: 862,817

[22] Filed: Dec. 21, 1977

[30] Foreign Application Priority Data

Jan. 7, 1977 [SE] Sweden ..... 7700115

[51] Int. Cl.[2] ..... F23D 15/00

[52] U.S. Cl. ..... 239/404; 239/590.3

[58] Field of Search ..... 239/404, 405, 406, 462, 239/494, 575, 533.3, 533.5, 590.3

[56] References Cited

U.S. PATENT DOCUMENTS

| | | | |
|---|---|---|---|
| 917,998 | 4/1909 | Baddington | 239/590.3 |
| 2,625,437 | 1/1953 | Huntington | 239/575 |
| 2,631,892 | 3/1953 | Czarnecki, Jr. et al. | 239/590.3 |
| 3,762,653 | 10/1973 | Gibel | 239/553.3 |
| 4,011,995 | 3/1977 | Krause, Jr. | 239/404 |
| 4,122,978 | 10/1978 | Guimond et al. | 239/575 |

*Primary Examiner*—James B. Marbert

*Attorney, Agent, or Firm*—Dann, Dorfman, Herrell and Skillman

[57] ABSTRACT

Purging apparatus for removing air from a fluid conduit is shown in the form of a burner nozzle which automatically purges air from the nozzle elements to thereby limit post-drip of liquid fuel from the nozzle. The nozzle is designed with a partitioning element within the nozzle adjacent the burner tip having at least one passage of limited cross-section which, in response to flow of liquid fuel therethrough, disperses or atomizes air bubbles which may be entrapped within the nozzle assembly. Several embodiments are illustrated and described in which a restricted passage in the partition is positioned adjacent the top of the interior chamber of the nozzle holder to pick up air bubbles and eject them through the nozzle tip.

32 Claims, 20 Drawing Figures

PURGING APPARATUS

The present invention relates to apparatus for purging air from conduits conducting a liquid fluid, and is particularly adapted for a fuel line having a burner nozzle of the type having a removable tip mounted in a holder.

It is a difficult and, up to the present invention, an unsurmounted problem to remove remaining air from the burner nozzle. A filter is normally built into such nozzles which, owing to its flow reducing effect, requires an enlargement of the flow-through area. The speed of the liquid to be burned, usually oil, decreases considerably with the result thay any air bubble or bubbles cannot be impelled by the liquid flow. While a liquid, e.g. oil, to only a very small extent reacts to pressure and changes of temperature in the form of volume changes, even a small quantity of air reacts very greatly to such changes in the form of an essential change of volume. In the burner nozzle, this becomes apparent in the form of so-called post-drip causing the formation of soot and carbon deposit on the nozzle and electrodes resulting in operational breakdowns. On the one hand, the pressure in the nozzle normally shifts between atmospheric pressure and pressure up to full line pressure, e.g. 10 kg/cm$^2$, and on the other hand, the inflowing oil in unheated condition is greatly heated in the nozzle by the post-heat present when combustion ceases. The air bubble cooled by the passing oil can herein be enlarged many times over and thereby cause the stated difficulties.

This problem has already been observed and one has attempted to overcome the same by suggesting that the nozzle, after assembly of the burner and during its starting operation, be loosened at the same time while the pump is in operation. Such a method of procedure is, however, very difficult and often purely impossible to accomplish owing to that the nozzle is difficult to reach. Even during replacement of the nozzle, one is faced with the same problem.

Practical tests with transparent nozzle holders have shown that the nozzle with relatively large capacity, for example 2 U.S. gallons per hour, is capable of ridding itself of the remaining air bubble after 300–500 starts, while the formation of soot and carbon deposit, of course, is already a fact. The problem increases with diminishing capacity and this has shown that it takes up to six months for a nozzle with the capacity 0.4–0.5 U.S. gallons per hour to become vented.

When the chamber that receives the filter is in the form of a threaded bore, it has shown that it is particularly impossible to remove the air out of such a chamber.

The object of the present invention is to counteract and, as far-reaching as possible, to remove the above-stated problem as well as over and above that to create a simple and inexpensive solution, which, as far as possible, is usable for present nozzles on the market and those already installed. Through tackling these problems, the view of the invention is even intended for saving energy.

These objects are achieved according to the present invention by a burner nozzle of the stated type which mainly is characterized by means for atomizing the fuel and air in the nozzle holder. Practical tests with the burner nozzle according to the invention have shown that complete venting can occur after 1–10 manipulated starts entailing from 15 seconds to 15 minutes normal operation time. Through this means, the formation of soot and carbon deposit can substantially or entirely be eliminated.

Further features and advantages of the invention are revealed by the following description with reference to the accompanying drawings which show some non-limited embodiments of burner nozzles according to the invention. In detailed diametric longitudinal and transverse sectional views and partially in schematic simplified construction, show:

Figure 1:
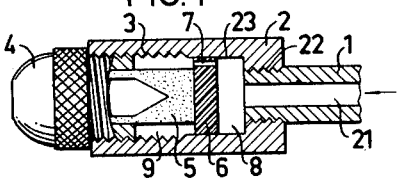
FIG. 1 illustrates a first embodiment with all elements in section.

In the following and in the drawing figures, the same or similar parts are designated with the same reference designations. Further in this connection the nozzle is considered as a unit, which includes both a so-called nozzle tip or the like, and a holder for it, as well as the inlet line belonging to it.

In the drawing figures, 1 designates an inlet line containing an inlet channel 21 which, e.g. leads from a pump (not shown) which, in turn, is connected to a storage reservoir for the liquid to be combusted, usually oil. The inlet line 1 opens into and is inserted in a holder 2 for a nozzle tip or the like 4, e.g. by means of inner threads in a passage hole 22 in the holder 2. The nozzle tip or the like 4 can have an arbitrary construction and is therefore shown only in elevation in the drawing figures. At it is known, nozzle tips usually consist of serveral parts, to which a conical section with tangential grooves belongs which gives the combustible liquid the desired dispersion. The nozzle tip or the like 4 can, of course, be given any construction desired.

As the nozzle tip or the like 4 can be screwed into the holder 2, the holder can therefore as designed as a cylinder or cup, and have an internal thread 3 which, by choice, can extend for a part of for the entire length of the interior wall of the holder. In the holder 2, the nozzle tip or the like 4 leaves a chamber 23 in which a filter 5 of intrinsically known construction is concentrically inserted, leaving a circumferential space free in the radial direction of the filter. Even in axial direction, the filter and the nozzle tip leave a space which is designated in its entirety by chamber 23. This chamber is divided by a partition disc 6 into a rear chamber section 8 of cylindrical form and a frontal section 9 of ring-like or annular shape. The disc 6 is inserted to seal against the interior wall in the chamber 23 and in principle to prevent the two sections of the chamber from communicating with one another with exception of passage means 7 in the form of one or several holes, grooves or the like. The disc 6 is preferably made of plastic or rubber and suitably has certain extensive dimension in axial direction, for example a few millimeters.

If the passage 7 consists of only one hole, groove or the like, the same is preferably arranged in the highest section of the disc 6. In such cases, the horizontally mounted holder 2 will therefore be provided with a mark so that the passage 7 always assumes a top position during assembly. The cross-section of the passage must be so small that the liquid is forced to pass through with relatively high speed. The cross-section of the passages 7 must consequently be a fraction of the cross-section of the inlet channel 21. But, in the first instance, the cross-section of the passage means 7 must be dimensioned in relation to the form and capacity of the nozzle so it is designed to accommodate the necessary flow of liquid fuel to the tip 4.

The burner nozzle of FIG. 1 functions in the following manner. After installation of the nozzle as a unit, air is present in the chamber 23. During the first start, the combustible liquid, e.g. oil, then flows in through the inlet channel 21, from where the oil flows further through the chamber section 8, the passage means 7, the chamber section 9, the filter 5 and out through the nozzle tip or the like 4. Since the passage 7 assumes a top position, the air collects more easily in the same top position and consequently immediately adjacent the passage and may form a bubble. The oil is forced to pass through the so-formed air bubble in the chamber section 8 and immediately pulls parts of the air bubble with it into the chamber section 9 where the air cannot remain in a top position either, since the upper section of the ring-like chamber section 9 is intensively flushed through by the in-rushing stream of oil. At this point, one or several air bubbles are quickly and intensively dispersed or atomized and follow with the stream of oil out through the tip 4. In this manner, a burner nozzle, according to the invention, can quickly rid itself of all enclosed air and warrant for a fault-free combustion.

Figure 2:
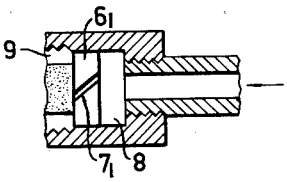
FIG. 2 illustrates a detailed portion of FIG. 1 seen from above in FIG. 1, however with a partition element of modified construction shown in elevation to show angular passage means.

As shown in FIGS. 1 and 2, the chamber section 9 is outwardly limited by an interior threaded section which has a tendency to retain enclosed air, which in the form of smaller bubbles, is to a certain extent protected against dispersement or atomization by the side walls of the threads. It has shown that this tendency of retention can be effectively counteracted if the passage means is obliquely positioned as shown at $7_1$ in FIG. 2. In this way, the oil in the chamber section 9 conveys a rotational movement which can effectively penetrate into the threads and pull bubbles present there with it. The passage $7_1$ must preferably be directed into the chamber section 9 in the same direction as the upward inclination of the threads from the hole.

As an alternative to a passage 7 formed in the partition disc 6, one can conceive such a passage may be formed in the holder 2 with otherwise the same construction and effects.

It can be further advantageous to give the disc 6 a somewhat greater diameter than the chamber 23 if the disc is to bear against the inner threaded section 3 in its working position. In this manner, the disc can be threaded into the threaded section 3 so that all oil is forced to pass through the passage 7. One can, of course, in certain cases conceive, particularly concerning threads 3 with very steep upward incline, eliminating a separate passage 7 and using the threaded section itself as the passage means in which the disc 6 in such a case may not engage the threads in a sealing manner, so that the desired quantity of oil can pass through the threads. In general, such a construction is, however, not to be preferred, since the intensity of the flow of oil then becomes uniform around the entire periphery of the disc and the desired strong intensity in the top area usually does not occur.

Figure 3:
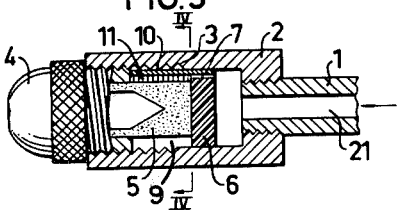
FIG. 3 illustrates a third embodiment.
Figure 4:
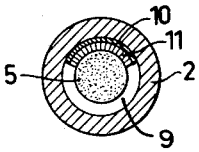
FIG. 4 is a diametric transverse section along the line IV—IV in FIG. 3.

The embodiment in FIGS. 3 and 4 can, to a large extent, or in principle, correspond with the embodiments according to FIGS. 1 or 2. In the chamber section 9, preferably only in its upper section, bristles or the like 11 are, according to this embodiment, arranged oriented radially in relation to the filter 5, which can extend forward against the filter from a curved protrusion 10 extending out from the disc 6 and preferably assembled in one piece with it and the bristles or the like. The protrusion 10 bears flat against the interior wall section of the chamber 9. The stated bristles have a dispersing or atomizing effect on the air bubbles which are consequently atomized and quickly come to be pulled through the filter 5 with the stream of liquid. Practical tests showed that even the chamber section 9 became completely free of air after three to four minutes during continual operation, or after a small number, e.g. four or five, of manipulated starts, whereby emptying of air can occur in only five to twenty seconds.

Figure 5:
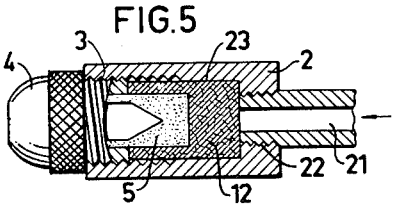
FIG. 5 illustrates a fourth embodiment.

In the embodiment according to FIG. 5, the entire chamber 23 is filled out with a fine fiber material 12 which can be steel wool, fine plastic wire or the like. In this case, the partitioning disc can be completely eliminated or one can, of course, also conceive including a disc 6 with passage 7, if so desired. Practical tests have shown that venting can occur in about 1 minute or after 2–3 manipulated starts, i.e. within 5–15 seconds. It would, of course, be sufficient if only the upper section of the chamber 23 is filled with such fine fibered material, but for the sake of simplicity, it will certainly be preferable to fill the entire chamber with this material. The fine fibered material 12, similar to the bristles or the like 11 or the disc 6 and the passage 7, insures an atomization of combustible liquid and air during simultaneous increase of speed of the liquid passing through the area. In this way, prerequisites are created for the atomization of the air bubbles to follow with the flow of liquid through the filter and out through the nozzle tip.

Figure 6:
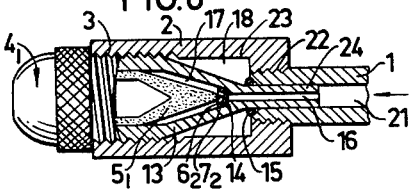
FIG. 6 illustrates a fifth embodiment.

In the embodiment according to FIG. 6, the nozzle tip or the like $4_1$ has been protruded all the way into the channel 21 of the inlet line 1 with an immediate conically inward tapering section 13 which, at the entrance in the inlet channel 21, with a pipe-shaped section 24, can by means of an o-ring 15 seal against the opening of the inlet channel. At the transition between the pipe-shaped section 24 and the conically inward tapering section 13, an inner shelf 14 is formed against which the disc $6_2$ with passage $7_2$ bears. In this case, the filter $5_1$ can have a more pointy construction and with the so-formed tip bear against the disc $6_2$. The pipe-shaped section 24 has a bore 16 through it. Further, in this embodiment, a ring-like annular chamber 17 is formed between the conical inward tapering section 13 and the filter $5_1$ and outside of the section 13 another ring-like annular chamber 18 is formed. Since the chamber 17 diverges in direction away from the disc $6_2$ and its passage $7_2$ is obliquely positioned, an intensive rotation of the combustible liquid is attained, and the air, so to speak, is pressed through the filter $5_1$ in that the combustible liquid is thrown against it from the end of the chamber facing away from the disc $6_2$, which end preferably tapers inward more and more during simultaneous diverging of the chamber in its entirety as is revealed in FIG. 6. Practical tests have also shown that such a burner nozzle can be free of air in approximately 10 seconds during normal operation. A certain amount of oil and air can eventually penetrate past the section 24 and the o-ring 15 to fill out the chamber 18 until the same pressure exists in it as that in the inlet channel 21. When the pump is stopped, the pressure in the inlet channel 21, the bore 16 and the chamber 17 falls and the pressure in the outer chamber 18 seals against the o-ring 15 and the inlet line 1 and remains until the next start.

Figure 7:
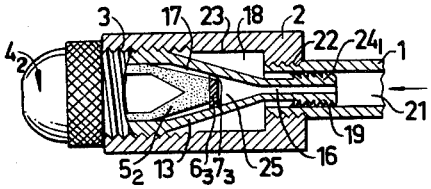
FIG. 7 illustrates a sixth embodiment.

The embodiment according to FIG. 7 corresponds to a large degree with the embodiment according to FIG. 6, but the o-ring has been replaced by circumferential gills 19 extending out from the pipe-shaped section 24 of the nozzle tip $4_2$. In this embodiment, the pipe-shaped section 24 is, of course, smaller in diameter than the inlet channel 21. The stated gills, which consist of plastic, rubber of some other elastic material that can be deformed and which in expanded condition have greater diameter than the intlet channel 21, bend during insertion and seal in direction against the flow of liquid when the pressure falls. Moreover, an inlet chamber 25 on the side of the disc $6_3$ facing away from the filter $5_2$ is shown in FIG. $7_3$, which chamber can, of course, also be found in FIG. 6.

Figure 8:
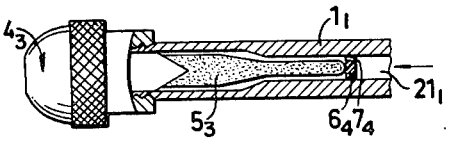
FIG. 8 illustrates a seventh embodiment.

In the embodiment according to FIG. 8, the disc $6_4$ with passage means $7_4$ is inserted in the inlet channel $21_1$ and the pointy and oblong-shaped filter $5_3$ extends a longer distance into the inlet line $1_1$, which is inserted in a sealing manner in the nozzle tip or the like $4_3$.

Figure 9:
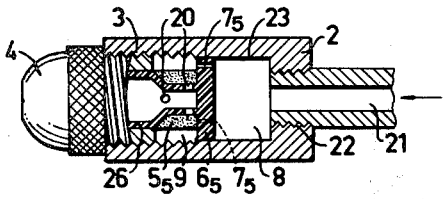
FIG. 9 illustrates an eighth embodiment.

In the embodiment according to FIG. 9, the disc $6_5$ is joined to the filter $5_5$ as a built-in unit by means of a sleeve-shaped section 26 concentrically extending out from the disc $6_5$ in direction toward the tip 4, which section can have relatively small diameter adjacent the disc $6_5$ and then expand to a greater diameter adjacent the tip 4, and in so doing, form the base and anchoring means for a ring-like filter $5_5$, which communicates with the interior side of the sleeve-shaped section 26 through holes 20, which preferably are partially displaced relative to one another in both axial direction and circumferential direction. In this case, the passage means comprises several holes or the like $7_5$ arranged in the disc $6_5$ displaceable by, e.g. 120° in circumferential direction. One can, of course, conceive a corresponding arrangement of the passage means 7 in the remaining embodiments.

Figure 10:
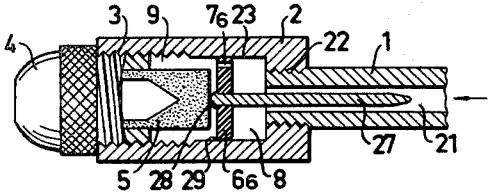
FIG. 10 illustrates a ninth embodiment.
Figure 11:
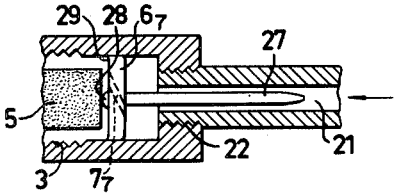
FIG. 11 illustrates a tenth embodiment with its partition element shown in elevation.
Figure 12:
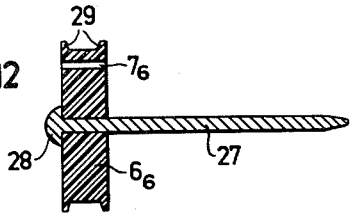
FIGS. 12 and 13 illustrate in detail an element of FIG. 10 in greater scale respectively before and after insertion in the nozzle holder.
Figure 13:
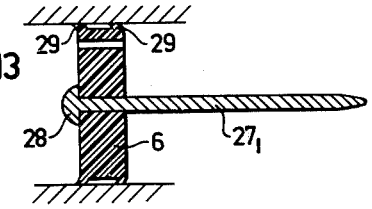

The embodiments according to FIGS. 10 and 11 correspond broadly with the embodiments according to FIGS. 1 and 2. According to FIG. 10, the disc $6_6$ can consequently have one or several straight holes 7, while the disc $6_7$ can, according to FIG. 11, have one or several obliquely positioned holes $7_7$. Alternatively, the passage means may comprise a small recess or groove in the outer periphery of the disc at the top position to insure a purging flow or flush of liquid in the top zone of the chamber 9. In both cases, the disc is provided with a central and axial guide member 27 which, with the one end, is anchored in the disc and, with the other end, extends into the inlet channel 21 while leaving free a continuous ring-like annular passage. With a head 28, the guide member 27 can form a spacer between the disc and the filter 5, if so desired. As revealed in detail in FIGS. 12 and 13, the disc $6_6$ is provided with circumferential lips 29 which can be elastically deformed during insertion of the disc into the chamber 23, as is revealed in FIG. 13. If the hole is eliminated, the lips may be notched or cut away at the top to provide a peripheral passage. One can, of course, conceive making the disc $6_6$ or $6_7$ and the guide member 27 in one piece, preferably of plastic. The guide member 27 guarantees insertion of the disc $6_6$ or $6_7$ without tilt and consequently, a perfect working position.

Figure 14:
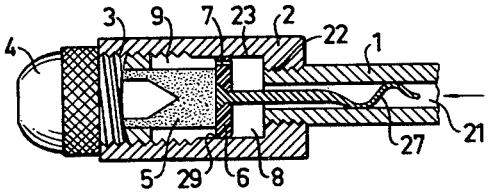
FIG. 14 illustrates an eleventh embodiment.
Figure 15:
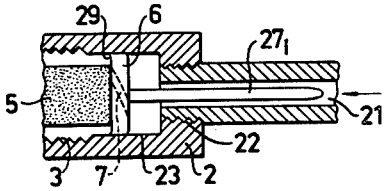
FIG. 15 illustrates a twelfth embodiment with its partition element in elevation.

The embodiments according to FIGS. 14 and 15 resemble the embodiments according to FIGS. 10 and 11. With the sole exception that the guide member $27_1$ is constructed in part with head sunken in the disc, so that any vacant distance between it and the filter 5 no longer is present, and the guide member $27_1$ is shaped with a wavy free end resulting in, e.g. vibration free anchoring in the inlet channel 21. Owing to that the guide member $27_1$ is made of plastic or other elastic material that can be deformed, adoption to different diameters of inlet channels 21 can occur. Even here, one can, of course, conceive a construction of the guide member and the disc as one piece, or a construction in which only one of these features of the member $27_1$ is utilized.

The embodiments according to FIGS. 6–8 and 10–15 insure a certain atomization in the inlet channel of air bubbles eventually coming in through the inlet channel.

Figure 16:
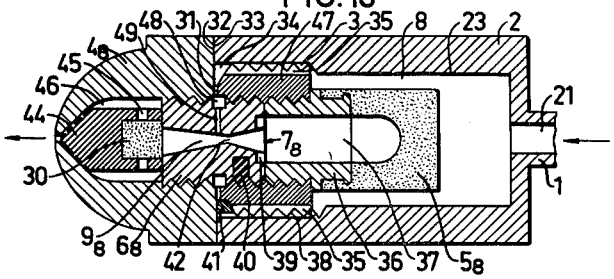
FIG. 16 illustrates a thirteenth embodiment according to the invention.
Figure 17:
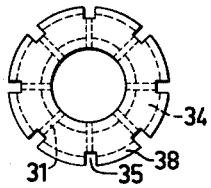
FIGS. 17 and 18 illustrate in front elevation elements incorporated in the embodiment according to FIG. 16.
Figure 18:
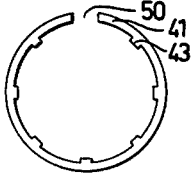

According to the embodiment shown in FIG. 16, a nozzle is provided with a thicker disc element $6_8$, which can be a locking screw intended to be inserted from behind into a nozzle tip element $4_8$ for locking a dispersion cone 44, which in its back end, can be provided with a filter 30. Radial holes 45 in said cone connect the filter 30 to a surrounding annular cavity 46. Within the holder 2, said disc or locking screw element is surrounded by a screw nut 47, a thread 38, of which is engaged in the thread 3 of said holder. Simultaneously into said screw nut is inserted a sleeve 36 protruding into chamber 23 and carrying a main filter $5_8$. The rear part 8 of the chamber 23 connects through said filter $5_8$ into the center of said sleeve 36 where it is hollow to provide a space 37. The outer thread of said screw nut 47 is crossed by axial grooves 35 which uniformly can be arranged about the periphery of said nut at a number of places, e.g. eight. Between the tip element $4_8$ and said holder 2, these grooves 35 connect to an annular groove 34 which, via radial connecting holes or passsages 31, communicates with an annular groove 48 in the outer surface of said locking element $6_8$. From here, one or several connecting channels or passages 49 lead to a hole $7_8$ extending through said disc element $6_8$, preferably centrally and axially. Said hole has preferably outwardly flared ends with a restriction 42 therebetween. incorporated in this embodiment are a control ring 41 with a passage or opening 50 and inwardly-directed protrusions 43 for insertion into non-used connecting holes 31. In that end of said disc element $6_8$, which is remote from said tip element $4_8$, there can be provided a screw-driver groove 39 and into the periphery of said disc element can be inserted a plastic plug 40 which can be intended to seal and/or lock the thread between said screw nut and said locking screw. In a conventional way, the holder 2 and the tip element $4_8$ are tightly interconnected by means of surfaces 32 and 33 abutting each other.

The embodiment as described above and shown in the drawings is especially suitable for available and installed components, especially with reference to the holder 2, the tip $4_8$, the sleeve 36, the filter $5_8$ and eventually the dispersion cone 44. If one wishes to avoid these components, more simple solutions are, of course, possible and certain parts may have different shapes and locations as desired.

The embodiment as shown and described works as follows. At the first start or when exchanging a nozzle or the like, all cavities are filled with air. Firstly, the incoming fluid pushes out the major part of entrapped air through the tip $4_8$ and a small amount of air remains uppermost in the rear part 8 of the chamber 23. Now fluid continues through main filter $5_8$ and passage $7_8$, auxiliary filter 30, holes 45, annular cavity 46 and out through the tip element. On this way, the fluid comes up to maximum speed when passing restriction 42, after which speed again is reduced due to the widening of passage $7_8$ to the forward part $9_8$ of the chamber. Since the fluid in the rear part 8 of the chamber 23 has the maximum pressure, the lower pressure arising in said passage $7_8$ has the possibility of being transferred through said connecting passage 49, annular groove 48, connecting passage 31, annular groove 34 and some of the axial grooves 35 to the top part of the chamber part 8, where the remaining air is entrapped. Due to these differences in pressure, said remaining air is now sucked out on the way as described into chamber part 9 and pressed out through tip $4_8$, which way is both short and having a small cross-sectional area, so that the air cannot be entrapped again. Practical tests have shown that such a nozzle is emptied from air within five seconds.

When mounting such a nozzle, the following procedure can be applied. A tip assembly provided with all parts except for the holder is screwed into the holder and the top part of said tip is marked or the whole periphery of said tip can be provided with some index, whereupon said tip is screwed out again and said control ring 41 is turned so that the opening 50 is located adjacent to the mark or the desired index point with access to the next axial groove 35 so that only the one connecting hole 31 obtaining a top position can communicate with the annular groove 48, meanwhile all the other connecting holes are blocked by said protrusions 43. In such a way, it can be guaranteed that a continuous suction is taking place only via the top part of chamber 8. One connecting passage 49 can suffice, but there can be several if so desired. Said ring 41 naturally cuts off all the axial grooves 35 which are not used.

All cross-sectional dimensions are chosen such that small air bubbles easily can flow with the fluid out into chamber part 9 without risking a new entrapping.

If one can guarantee by certain means a certain top position of holder 2, naturally a considerably more simple constructional design can be chosen for such a nozzle with only one axial groove or the like 35 and only one connecting hole or passage 31. However, the principle according to the invention is not changed. Naturally the hole $7_8$ need not have flared ends. Instead, the end closest to the chamber part 8 may be a cylindrical hole with relatively small diameter which somewhere within said partitioning element can be widened to an enlarged diameter, e.g. also cylindrical. Even one continuous cylindrical passage is possible with a reducing lip, orifice, or the like creating a pressure drop in downstream direction.

Said screw nut 47 can also be made as a unit with said tip $4_8$. Instead of axially continuous grooves 35, only some shorter axial cuts can be provided in at least the upper part of the holder commencing from chamber part 8 which cuts in connection with normal or enlarged thread clearance, allow air to come into the thread and be sucked around and finally into the annular groove 34. Particularly in this case, it can be sufficient with only one connecting passage 31. Especially in this case, but also generally, said control ring 41 can be omitted without losing the desired effect of removing air from the nozzle assembly.

Figure 19:
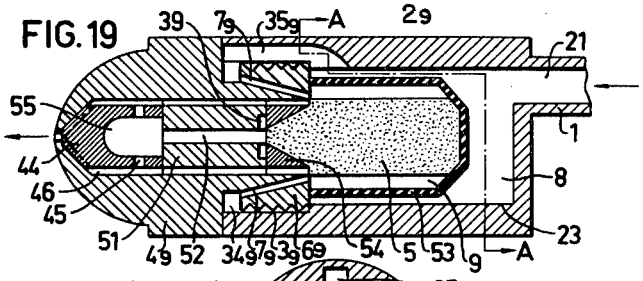
FIG. 19 illustrates a fourteenth embodiment according to the invention.
Figure 20:
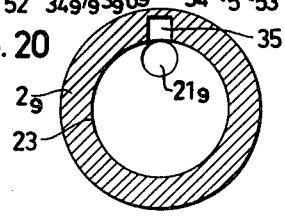
FIG. 20 is a sectional view taken on line A—A in FIG. 19.

The embodiment according to FIGS. 19 and 20 includes some further new principles leaving the main principles according to the invention unchanged. In this embodiment, the holder $2_9$ has a channel $21_9$ connected eccentrically, preferably to the top zone. (This also can be the case for all the other embodiments, where this is possible.) Similar to FIG. 16, a tip $4_9$ incorporates a dispersion cone 44 to provide an annular cavity 46 and radial holes 45 commencing from a cavity 55, to which is connected a continuous axial bore 52 in a connecting piece 51. The piece 51 acts as locking bolt and in one end provided with a screw driver groove 39, against which end abuts a filter support 54 of a filter $5_9$ which is inserted into a partitioning disc element $6_9$, which is provided with an outer thread $3_9$, and which preferably is made in one piece with tip element $4_9$. At least uppermost, i.e. at top position, said holder $2_9$ where it abuts the tip $4_9$, is provided with an internal axial groove $35_9$, which can bypass thread $3_9$ and interconnect an annular groove $34_9$ with the top zone of the rear part $8_9$ of the chamber $23_9$. Surrounding the filter $5_9$ and spaced outwardly therefrom, an elastic casing 53 encloses and defines a chamber part 9 between itself and filter $5_9$. This chamber part 9 communicates with the annular groove 34 and the axial groove 35 as well as the upper part of the rear part 8 of the chamber 23 via passages $7_9$ which preferably are arranged in a plurality of places uniformly spaced circumferentially about the partioning element $6_9$. These holes or passages $7_9$ may be somewhat inclined.

Such a nozzle works as follows. When fluid enters chamber part 8, there arises a pressure, which compresses said elastic casing until chamber part 9 finally is eliminated. Simultaneously fluid passes through the axial groove $35_9$, the annular groove $34_9$ and passage holes $7_9$, through filter $5_9$, bore 52, cavity 55, holes 45, annular cavity 46 and out through the tip. Air entrapped uppermost in chamber part 8 is simultaneously carried out quickly and efficiently. Hereby the phenomenon arises that air which is relatively light is given priority by the fluid which is much heavier so that practically the whole nozzle is empty from air when fluid emerges from the nozzle. Due to that the elastic casing is sealingly connected to said partioning disc element $6_9$, a suction can arise even after fluid supply is cut off, when said casing expands and sucks in fluid and some small air bubbles eventually remaining in the uppermost part of chamber part 8 efficiently through the axial groove 35, the annular groove 34 and holes $7_9$. This air will stay in chamber part 9 and will be pressed out immediately and effectively through filter $5_9$ and tip $4_9$ at the next start. In such a way, at least at the second start, a guaranteed complete air emptying of the whole nozzle is achieved. It can also be mentioned that after the first start, a positive control of more or less complete air emptying can take place, if the casing 53 is allowed to expand when substantially all the air (which is much lighter and more easily compressible) is pressed out of said nozzle. Such an expansion of the casing can take place during operation if, among other things, the various dimensions allow this. According to a modified embodiment, said casing 53 can be substantially non-compressible, in which case said annular chamber part 9 preferably is chosen with relatively small width, so that through the small holes $7_9$, incoming small air bubbles easily can be pushed through the filter and out through the tip $4_9$ by the fluid stream which, accordingly, is very intensive in chamber 9. Finally, said holes $7_9$ can end in such a way in relation to an elastically deformable casing that this casing immediately upon commencement of fluid supply is compressed and covers at least partly the ends of said passages adjacent the filter $5_9$ so that only the air, which is more easily compressible in general, can pass through the ends of said passages until generally all air has passed out of said nozzle.

The forms of the embodiment described above and illustrated in the drawings are only to be considered as nonlimiting examples which can be modified and supplemented at will within the scope of the inventive idea and the following claims.

I claim:

1. Purging apparatus for removing air bubbles from a liquid flow conduit comprising a hollow holder, a nozzle tip element mounted at one end of said holder, an inlet channel opening into the other end of said holder, a chamber between the opposite ends of the holder, and a filter in said chamber disposed in the liquid path from said chamber to said tip element, the improvement comprising means in the chamber for atomizing liquid and entraining air in its path from said inlet channel to said tip element, said means including a partitioning means comprising a disc dividing said chamber into a rear part and a front part, and a restricted flow passage adjacent the wall of said front part interconnecting said rear and front parts of the chamber, said restricted passage increasing the speed of the flow of liquid passing through the passage and adjacent the wall of said front part to entrain air bubbles in said holder into the liquid flow and atomize the liquid prior to the passage of said liquid through said filter and said nozzle tip element.

2. Purging apparatus according to claim 1, wherein said chamber extends substantially horizontal and said partitioning disc is upright, said passage being in the top area of the chamber.

3. Purging apparatus according to claim 1, wherein the restricted passage is formed in the wall of the chamber.

4. Purging apparatus according to claim 1 wherein said restricted passage is a hole in said disc.

5. Purging apparatus according to claim 1, wherein said restricted passage extends angularly to impart a swirling flow in said front part.

6. Purging apparatus according to claim 5, wherein the wall of the front part of said chamber is at least partially threaded and wherein further said angular restricted passage is canted in the same direction as the threads in said chamber wall.

7. Purging apparatus according to claim 1, wherein at least one section of the hollow holder is internally threaded, and wherein further said disc is of material that can be deformed and has a somewhat greater diameter than the free cross-section of the internal threads of the holder, so that the disc can be threaded into said holder and formed with outer threads while being driven in.

8. Purging apparatus according to claim 1, wherein at least one part of the chamber has a threaded wall portion with very steep thread inclination, and wherein further the space between the threads in the threaded section of the chamber comprises the restricted passage for atomization of the liquid and entrainment of air into said liquid flow.

9. Purging apparatus according to claim 1, wherein said filter is positioned within said front part with an annular space between the filter and the wall and including bristles which are radially oriented in relation to the filter in the front part of the chamber in the area where said restricted flow passage connects to said front part.

10. Purging apparatus according to claim 9, wherein the partition means has a curved protrusion extending into said front part and said bristles are mounted in engagement with said protrusion.

11. Purging apparatus according to claim 1, wherein said disc is provided with a central and axial guide member projecting rearwardly therefrom, its free rear end extending into the inlet channel while leaving free a continuous annular passage of restricted flow area to increase the speed of the flow of liquid in said annular passage.

12. Purging apparatus according to claim 11, characterized in that said guide member has a head projecting fowardly to constitute a spacer member between the disc and the filter.

13. Purging apparatus according to claims 11 or 12, wherein the rear free end of said guide member is wavy and can be elastically deformed during insertion into the inlet channel.

14. Purging apparatus according to claim 1, wherein said disc is releasably mounted in said hollow chamber and has at least one circumferential lip which can be elastically deformed during insertion of the disc into the chamber.

15. Purging apparatus according to claim 1, characterized in that the cross-sectional area of said passage amounts to only a fraction of the cross-sectional area of the inlet channel and is relatively small relative to the designed capacity of the nozzle tip element.

16. Purging apparatus according to claim 1, wherein said partition means is mounted in said inlet channel, said filter being pointed and oblong in form and extending into the inlet channel to a point adjacent said partition means.

17. Purging apparatus according to claim 1, wherein said partition means is joined with the filter as built-in unit by means of a sleeve-like section extending concentrically from the partition means in the direction toward the nozzle tip element, said section having an internal bore communicating with said nozzle tip, said filter being annular and surrounding said section, said section having means affording flow of liquid through said filter into the bore of said section, and means engaging said section with the nozzle tip element.

18. Purging apparatus for removing air bubbles from a liquid flow conduit comprising a hollow holder, a nozzle tip element mounted at one end of said holder, an inlet channel opening into the other end of said holder, a chamber between the opposite ends of the holder and a filter in said chamber disposed in the liquid path from said chamber to said tip element, the improvement comprising means in the chamber for atomizing liquid and entraining air in its path from said inlet channel to said tip element, said means including a partitioning means dividing said chamber into a rear part and a front part, and a central flow passage disposed substantially centrally in said partition interconnecting said rear and front parts of the chamber, said central passage having a restriction increasing the speed of flow of liquid passing through the passage adjacent said front part, and connecting passage means interconnecting said front part adjacent said restriction with the top area of said rear part to entrain air bubbles in said holder into the liquid flow and atomize the liquid prior to the passage of said liquid through said filter and said nozzle tip element.

19. Purging apparatus according to claim 18, wherein said tip element has a cavity therein, said partition means having a cylindrical body with an outer thread and retained within both the cavity of said tip element and the hollow part of said holder in the transitional zone between the tip element and the holder, said cylindrical body having an outer annular groove forming a part of said connecting passage means.

20. Purging apparatus according to claim 18, wherein said partition means has external threads engaging the internal wall of said holder to retain the partition means in place, said threads having axial grooves forming a part of the connecting passage means between said front and rear chamber parts.

21. Purging apparatus according to claim 20, wherein said passage means includes inner and outer annular grooves and a plurality of radial passages between annular grooves about their circumference, said holder being mounted to dispose the common axis of said annular grooves substantially horizontal, and a control ring mounted in one of said grooves having means for blocking off all of said radial passages not obtaining a top position and also having an opening in top position to afford connection between said front and rear parts therethrough.

22. Purging apparatus according to claim 18 characterized in that said restricted passage is provided with at least one flared end, beyond said restriction in the front part of the chamber, said connecting passage means being disposed adjacent said restriction.

23. Purging apparatus according to claim 18, wherein said filter is within said front chamber part at the exit end of said restricted passage and including an auxiliary filter in the rear chamber part adjacent said inlet end of said restricted passage.

24. Purging apparatus for removing air bubbles from a liquid flow conduit comprising a hollow holder, a nozzle tip element mounted at one end of said holder, an inlet channel opening into the other end of said holder, a chamber between the opposite ends of the holder and a filter in said chamber disposed in the liquid path from said chamber to said tip element, the improvement comprising means in the chamber for atomizing liquid and entraining air in its path from said inlet channel to said tip element, said means including a partitioning means dividing said chamber into a rear part and a front part, and a flow passage interconnecting said rear and front parts of the chamber, said passage being restricted, increasing the speed of the flow of liquid passing through the passage to entrain air bubbles in said holder into the liquid flow and atomize the liquid prior to the passage of said liquid through said filter and said nozzle tip element, said front part being annular and housing said filter, said partition including an elastic casing surrounding said annular front part, at least a portion of said rear part surrounding said casing.

25. Purging apparatus according to claim 24 wherein said restricted passage comprises one groove in the top area of said holder interconnecting the top area of the rear chamber part with said rear chamber part surrounding said filter.

26. Purging apparatus according to claim 25, wherein said restricted passage of said partition means comprises an annular groove coaxial with said front chamber part and disposed between said restricted passage and said front chamber part, and a plurality of individual passage holes leading from said annular groove to said annular front chamber part.

27. Purging apparatus according to claim 26, wherein said individual passage holes enter said front chamber part adjacent said elastic casing, said elastic casing being sufficiently deformable to block off said passage holes selectively when the pressure in the rear chamber part exceeds the pressure in the front chamber part.

28. Purging apparatus for removing air bubbles from a liquid flow conduit comprising a hollow holder, a nozzle tip element having a front end mounted at one end of said holder, an inlet channel opening into the other end of said holder, said nozzle tip element having rear sections extending through said holder into the inlet channel with a substantially conical, inwardly-tapering section in the holder and a hollow cylindrical section in said inlet channel, means sealing said hollow cylindrical section against said inlet channel, a chamber between the opposite ends of the holder, a filter in said chamber disposed in the liquid path from said chamber to the front end of said tip element, and means in the chamber for atomizing liquid and entraining air in its path from said inlet channel to said tip element including a restricted flow passage within said tapering section increasing the speed of the flow of liquid passing through the passage to entrain air bubbles in said holder into the liquid flow and atomize the liquid prior to the passage of said liquid through said filter and the front end of said nozzle tip element.

29. Purging apparatus according to claim 28 having an inner shelf at the transition between the hollow cylindrical section and the substantially conical, inward-tapering section and partition means mounted on said shelf and having said restricted flow passage therein, said filter having a pointed construction and bearing against the partition means in said tapering section.

30. Purging apparatus according to claim 28 wherein the inward-tapering section and the filter define therebetween an annular chamber which diverges and diminishes in height toward the front end of the nozzle tip element, said inward-tapering section being surrounding by another annular chamber within said holder.

31. Purging apparatus according to claim 28 wherein said sealing means comprises an O-ring.

32. Purging apparatus according to claim 28 wherein the hollow cylindrical section has smaller outer diameter than the interior diameter of the inlet channel and is surrounded by circumferential gills which are deformed during insertion to seal against the interior fo the inlet channel.

* * * * *